US010118082B2

(12) United States Patent
Gait et al.

(10) Patent No.: US 10,118,082 B2
(45) Date of Patent: Nov. 6, 2018

(54) PADDING ARRANGEMENT FOR LACROSSE GLOVE WITH IMPROVED FLEXIBILITY

(71) Applicant: Under Armour, Inc., Baltimore, MD (US)

(72) Inventors: Paul Gait, Altamont, NY (US); Chris Perra, Albany, NY (US); Patrick McKernan, Albany, NY (US)

(73) Assignee: Under Armour, Inc., Baltimore, MD (US)

( * ) Notice: Subject to any disclaimer, the term of this patent is extended or adjusted under 35 U.S.C. 154(b) by 684 days.

(21) Appl. No.: 14/851,547

(22) Filed: Sep. 11, 2015

(65) Prior Publication Data

US 2017/0072287 A1 Mar. 16, 2017

(51) Int. Cl.

| | |
|---|---|
| ***A63B 71/14*** | (2006.01) |
| ***A41D 13/015*** | (2006.01) |
| *A41D 19/015* | (2006.01) |
| *A63B 102/14* | (2015.01) |

(52) U.S. Cl.

CPC ..... *A63B 71/143* (2013.01); *A41D 13/015* (2013.01); *A41D 19/01523* (2013.01); *A63B 2102/14* (2015.10)

(58) Field of Classification Search

CPC ..... A63B 71/143; A41D 13/015

See application file for complete search history.

(56) References Cited

U.S. PATENT DOCUMENTS

| | | | | |
|---|---|---|---|---|
| 5,237,703 | A * | 8/1993 | Brine | A63B 71/143 2/16 |
| 5,511,243 | A * | 4/1996 | Hall | A63B 71/143 2/16 |
| D446,888 | S | 8/2001 | Morrow | |
| 6,550,069 | B1 * | 4/2003 | Morrow | A63B 71/141 2/16 |
| 7,530,120 | B2 * | 5/2009 | Morrow | A63B 71/143 2/161.1 |
| 8,640,263 | B2 * | 2/2014 | Copeland | A63B 71/143 2/161.1 |
| 9,113,664 | B2 * | 8/2015 | Copeland | A63B 71/143 |
| 2009/0044306 | A1 * | 2/2009 | Lamson | A41D 19/01523 2/16 |
| 2015/0106990 | A1 * | 4/2015 | Gait | A63B 71/143 2/20 |

* cited by examiner

*Primary Examiner* — Richale Quinn

(74) *Attorney, Agent, or Firm* — Harness, Dickey & Pierce, P.L.C.

(57) ABSTRACT

A protective sports glove is provided with a padding arrangement having improved flexibility for the user of the protective glove. The glove includes: a palm portion that cooperates with a dorsal portion to receive a metacarpus part of a hand. A plurality of finger portions are formed at a joint along a top edge of the dorsal portion distal from a wrist. A backside pad is attached to the dorsal portion, such that the upper edge of the pad aligns with and extends along at least a portion of the joint but is detached from the dorsal portion. A plurality of padded segments are disposed along a length of each of said finger portions. The one padded segment is attached to the respective finger portion at opposing side edges thereof and detached along an edge adjacent to the joint with the dorsal portion.

19 Claims, 7 Drawing Sheets

PADDING ARRANGEMENT FOR LACROSSE GLOVE WITH IMPROVED FLEXIBILITY

FIELD

The present disclosure relates to a protective glove and more particularly to a protective glove for use during an athletic activity such as lacrosse or hockey.

BACKGROUND

Protective gloves are typically used in contact sports such as lacrosse and hockey to protect a player's hand and wrist from injuries caused by another player's stick. Such gloves are specifically designed to protect against injuries when the player is checked or slashed and, as a result, often include padding and other protective materials that surround an exterior portion of the glove. While conventional protective gloves provide adequate protection during play, the padding and other protective materials that surround the exterior portion of the glove typically hinder the player's ability to bend or flex the player's hand and properly grasp a lacrosse or hockey stick. Therefore, it is desirable to provide a padding arrangement with improved flexibility for the user of the protective glove.

This section provides background information related to the present disclosure which is not necessarily prior art.

SUMMARY

This section provides a general summary of the disclosure, and is not a comprehensive disclosure of its full scope or all of its features.

A protective sports glove is provided with an improved padding arrangement. The glove is comprised of: a palm portion; a dorsal portion opposing the palm portion, and a plurality of finger portions. The dorsal portion attaches to the palm portion and cooperates with the palm portion to receive a metacarpus part of a hand. The plurality of finger portions are formed at a joint along a top edge of the dorsal portion distal from a wrist and extending away from the dorsal portion, where the joint extends substantially the entirety of the top edge between opposing side edges of the dorsal portion. At least one backside pad is attached to the dorsal portion, the backside pad having an upper edge and at least two other edges, such that the upper edge of the backside pad aligns with and extends along at least a portion of the joint. The upper edge of the backside pad is detached from the dorsal portion while the two other edges of the pad are attached to the dorsal portion.

In one embodiment, the backside pad has a T shape, such that a top of the T aligns with the joint. Two lateral backside pads can be positioned on opposing lateral sides of the backside pad, wherein each lateral backside pad defines an upper edge, a lower edge and at least two lateral edges, such that upper edge and the lower edge are attached to the dorsal portion and the at least two lateral edges are detached to the dorsal portion.

In some embodiments, the lower edge of the backside pad is attached via a tether to the dorsal portion and attached adjacent to a bottom edge of the dorsal portion. The tether may be comprised of an elastic material and biases the lower edge of the backside pad towards the wrist protection portion.

In another aspect of this disclosure, the protective sports glove is provided with a different pad arrangement. The glove is comprised of: a palm portion; a dorsal portion opposing the palm portion; a plurality of finger portions secured at a joint along a top edge of the dorsal portion distal from a wrist and extending away from the dorsal portion, where the joint extends substantially the entirety of the top edge between opposing side edges of the dorsal portion. A plurality of padded segments extend along a length of each of said finger portions, including one padded segment proximate to the joint. The one padded segment is attached to the respective finger portion at opposing side edges thereof and detached along an edge adjacent to the joint with the dorsal portion. The glove may further include a wrist portion attached to an edge of the dorsal portion proximate to the wrist and opposite the distal edge of the dorsal portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 3:
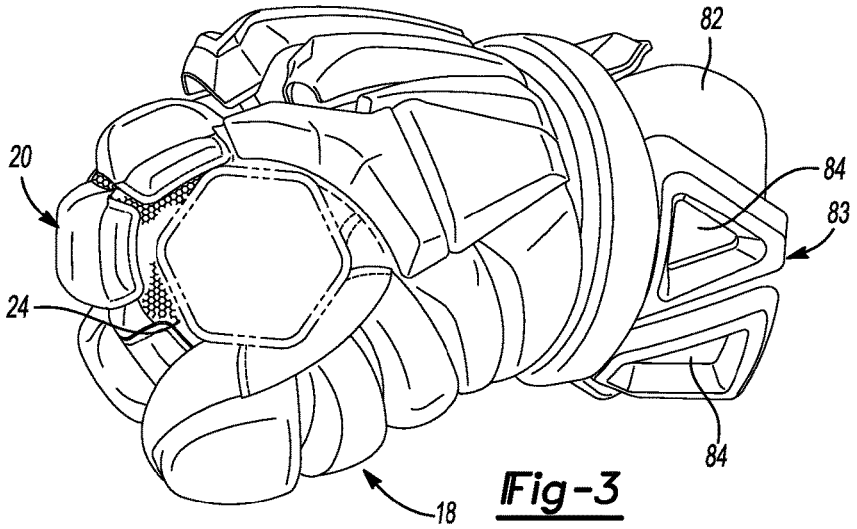
FIG. 3 is a side view of the protective glove of FIG. 1 shown in a flexed state and grasping a stick.

With reference to the figures, a glove 10 is provided and includes a hand portion 12 and a wrist portion 14. The glove 10 may be worn by a lacrosse player or a hockey player to protect the player's hand and wrist. Namely, the hand portion 12 and the wrist portion 14 cooperate to protect the player's hand and wrist from injuries while concurrently allowing the player to easily grasp a lacrosse stick (FIG. 3) or a hockey stick.

Figure 2:
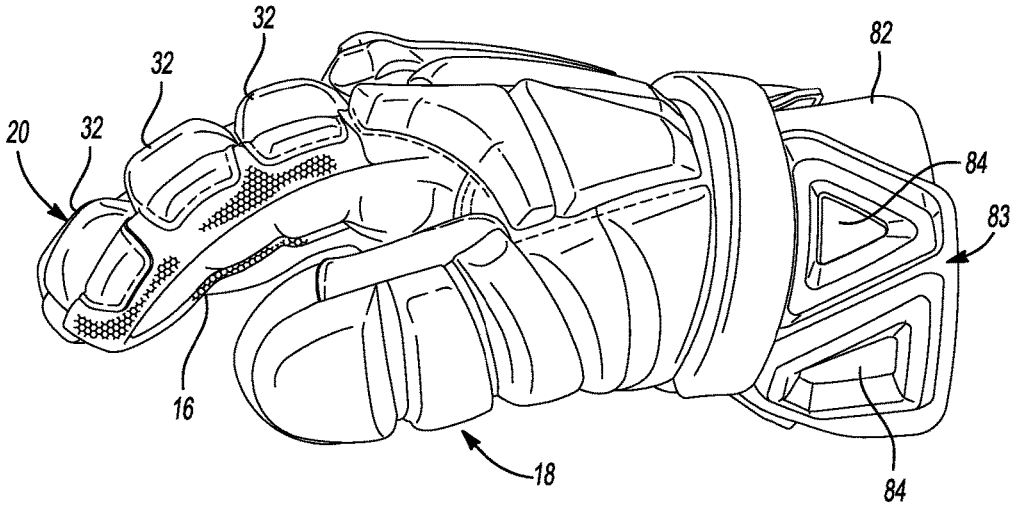
FIG. 2 is a side view of the protective glove of FIG. 1 shown in a relaxed state.

The hand portion 12 includes a palm portion 16, a thumb portion 18, a plurality of finger portions 20, and a back (or dorsal) portion 22. The palm portion 16 is formed on an opposite side of the hand portion 12 than the back portion 22 and opposes a lacrosse stick 24 (FIG. 3), for example, during use. In one example, the palm portion 16 may be comprised of a suede material although other types of materials are also contemplated by this disclosure. The palm portion 16 may also be formed from a material having embedded rubber to increase friction between the hand portion 12 and the lacrosse stick 24, thereby allowing a player to firmly grasp the lacrosse stick 24. In addition, the palm portion 16 may include one or more gripping features 26 (FIG. 2) that further increase friction between the palm portion 16 and the lacrosse stick 24. Such gripping features 26 may be attached to the palm portion 16 via stitching and/or adhesive and may be formed from a combination of leather and rubber.

The back portion 22 is formed on an opposite side of the hand portion 12 from the palm portion 16 and extends over the palm portion 16, the thumb portion 18, and the finger portions 20. The back portion 22 cooperates with the palm portion to receive a metacarpus part of the hand. In one embodiment, the back portion 22 has a single layer construction which may or may not include openings therethrough for increased flexibility. In other embodiments, the back portion 22 has a multi-layer construction, for example comprised of comfort foam stitched to a second foam layer and covered by a mesh. Other types of breathable materials may also be used for constructing the back portion 22. Pad segments may be attached to the back portion 22 in the manner further described below.

The thumb portion 18 and the finger portions 20 encircle the player's thumb and fingers during use. The thumb portion 18 and the finger portions 20 are sized and spaced apart from one another to properly receive the thumb and fingers of a player's hand. The thumb portion and the finger portions extend in a direction generally away from the wrist portion 14. More specifically, the finger portions 20 form a joint 39 with the back portion 22 along a top edge of the back portion 22 which is distal from the wrist portion 14, where the joint 39 extends substantially the entirety of the top edge between opposing side edges of the back portion 22.

The hand portion 12 additionally includes a padded portion 30 extending over and attached to the back portion 22 of the glove. The padded portion 30 includes series of padded segments 32 protecting each finger and at least one backside pad 34 protecting backside of the user's hand. It is envisioned that other types of pads may be incorporated into the glove as well.

Figure 6:
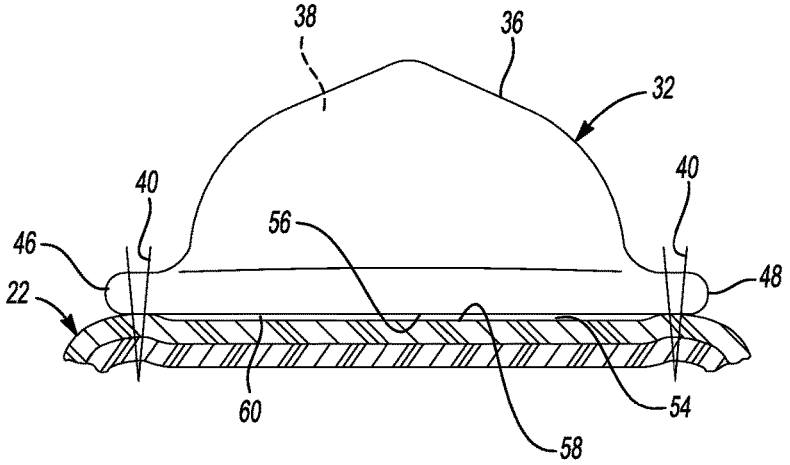
FIG. 6 is a cross-sectional view of the protective glove of FIG. 1 shown in a relaxed state and taken along line 6-6 of FIG. 5.

The series of padded segments 32 extend along a length of each of finger portion 20. Referring to FIG. 6, the padded segments 32 each include an outer layer 36 that generally surrounds an inner, energy-absorbing pad or block 38. The outer layer 36 may be formed from virtually any material such as, for example, leather, nylon, polyester knit, and Lycra® and may surround the energy-absorbing pad 38 such that the energy-absorbing pad 38 is not visible once the outer layer 36 and the energy-absorbing pad 38 are attached to the back portion 22. The energy-absorbing pad 38 may be formed from any suitable energy-absorbing material such as, for example, foam.

In one configuration, the outer layer 36 is formed from polyurethane (PU) leather that is laminated to ethylene-vinyl acetate (EVA) foam. The PU leather and the EVA foam are then compression molded to form an outer layer of the padded segments 32. The EVA foam provides the padded segments 32 with a degree of rigidity while the PU leather provides a desired aesthetic appearance. Further, compression molding the PU leather and EVA foam creates a molded skin of each padded segment 32 that has a cavity shaped to receive an energy-absorbing pad 38. The energy-absorbing pad 38 is inserted into the cavity and may be secured therein via a suitable adhesive. Once the energy-absorbing pad is received with in the cavity, the PU leather and EVA foam is wrapped around the energy-absorbing pad 38 and held in place via a suitable adhesive.

As described, the energy-absorbing pads 38 are constructed of individual, discrete foam blocks that are wrapped by the outer layer 36 and are attached to the back portion 22 via stitching 40. The stitching 40 may extend through a portion of the outer layer 36 (i.e., through the PU leather and the EVA foam) and into the back portion 22 to attach each of the energy-absorbing pads 38—via the outer layer 36—at a desired location along a longitudinal axis 42 (FIG. 1) of each of the finger portions 20 and, likewise, along a longitudinal axis 44 (FIG. 1) of the thumb portion 18. Methods other than stitching are also envisioned for attaching the pads to the back portion 22.

Figure 5:
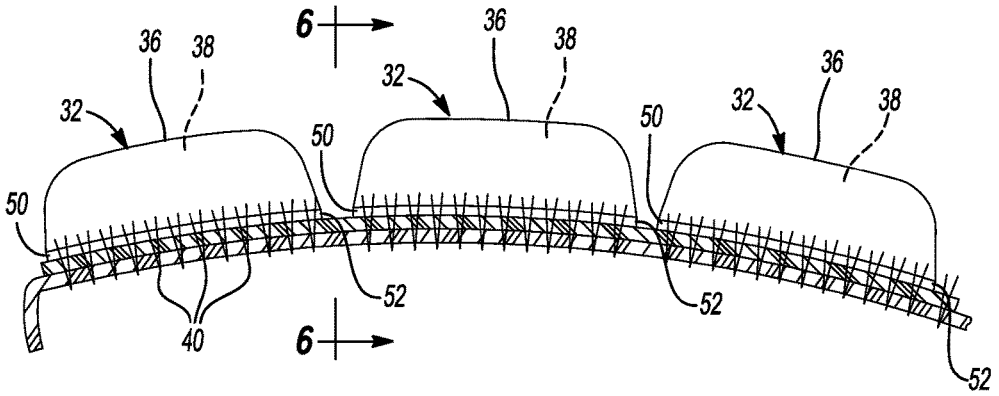
FIG. 5 is a cross-sectional view of the protective glove of FIG. 1 taken along line 5-5 of FIG. 1.

With particular reference to FIGS. 5 and 6, the stitching 40 associated with each of the padded segments 32 is shown as extending along a first edge 46 and a second edge 48 of each padded segment 32. The first edge 46 and the second edge 48 are disposed on opposite sides of the padded segments 32 and each extend in a direction substantially parallel to the longitudinal axis 42 of each finger portion 20 and, likewise, extend substantially parallel to the longitudinal axis 44 of the thumb portion 18. The padded segments 32 additionally include a third edge 50 and a fourth edge 52 that are formed on opposite sides of the padded segments 32 and are each disposed substantially perpendicular to the first edge 46 and the second edge 48. Accordingly, the third edge 50 and the fourth edge 52 are formed substantially perpendicular to the longitudinal axis 42 of the finger portions 20 and are formed substantially perpendicular to the longitudinal axis 44 of the thumb portion 18.

As shown in FIG. 6, only the first edge 46 and the second edge 48 are attached to the back portion 22 via stitching 40. The third edge 50 and the fourth edge 52 are not attached to the back portion 22 and, as such, are spaced apart and separated from the back portion 22 by a gap 54. The gap 54 extends along a length of each padded segment 32 in a direction substantially parallel to the longitudinal axis 42 of the finger portions 20 and in a direction substantially parallel to the longitudinal axis 44 of the thumb portion 18 such that a back surface 56 of each padded segment 32 is spaced apart and separated from an outer surface 58 of the back portion 22 along the entire length of each padded segment 32.

The back surface 56 of the padded segments 32 includes a joint between respective ends of the PU leather and EVA foam of the outer layer 36 caused by wrapping the outer layer 36 around each energy-absorbing pad 38. The joint is therefore disposed within the gap 54 and opposes the outer surface 58 of the back portion 22 to hide the joint from view once the padded segments 32 are attached to the back portion 22.

The gap 54 created between the back surface 56 of the padded segments 32 and the outer surface 58 of the back portion 22 is accessible at each of the third edge 50 and the fourth edge 52, as the third edge 50 and the fourth edge 52 are not attached to the back portion 22. Accordingly, a passageway 60 extends along a length of each padded segment 32 in a direction substantially parallel to the longitudinal axis 42 of each finger portion 20 and substantially parallel to the longitudinal axis 44 of the thumb portion 18 and is accessible at each of the third edge 50 and the fourth edge 52.

The passageway 60 is defined generally between the back surface 56 of each padded segment 32 and the outer surface 58 of the back portion 22 and is bounded by the first edge 46 and the second edge 48. Namely, because the first edge 46 and the second edge 48 are attached to the back portion 22 along a length of each padded segment 32 via the stitching 40, the passageway 60 is bounded by the first edge 46 and the second edge 48. In short, the size and shape of the passageway 60 is defined by attachment of the first edge 46 and the second edge 48 to the back portion 22 via the stitching 40, as well as by the opposing surfaces 56, 58 of the padded segments 32 and the back portion 22, respectively.

Attaching the padded segments 32 to the back portion 22 at only two edges (i.e., the first edge 46 and the second edge 48) while allowing the third edge 50 and the fourth edge 52 to be detached from the back portion 22 provides the thumb portion 18 and each finger portion 20 with increased flexibility, thereby allowing a player to more easily grasp a lacrosse stick 24, for example. Of note, the padded segment proximate to the joint as indicated at 39 is attached in a similar manner. That is, the padded segment 32 is attached along opposing side edges thereof and detached along the edge adjacent to the joint 39 with the back portion 22.

Further, attaching the padded segments 32 individually to the back portion 22 at the first edge 46 and at the second edge 48 allows each padded segment 32 to be individually attached to the back portion 22 separate and apart from adjacent padded segments 32. Attaching the padded segments 32 to the back portion 22 independent from adjacent padded segments 32 additionally increases the flexibility of the thumb portion 18 and the finger portions 20 as adjacent padded segments 32 do not hinder movement of one another. Finally, attaching the padded segments 32 to the back portion 22 independent from one another allows adjacent padded segments 32 to be spaced apart and separated from one another, as shown in FIG. 5.

Figure 1:
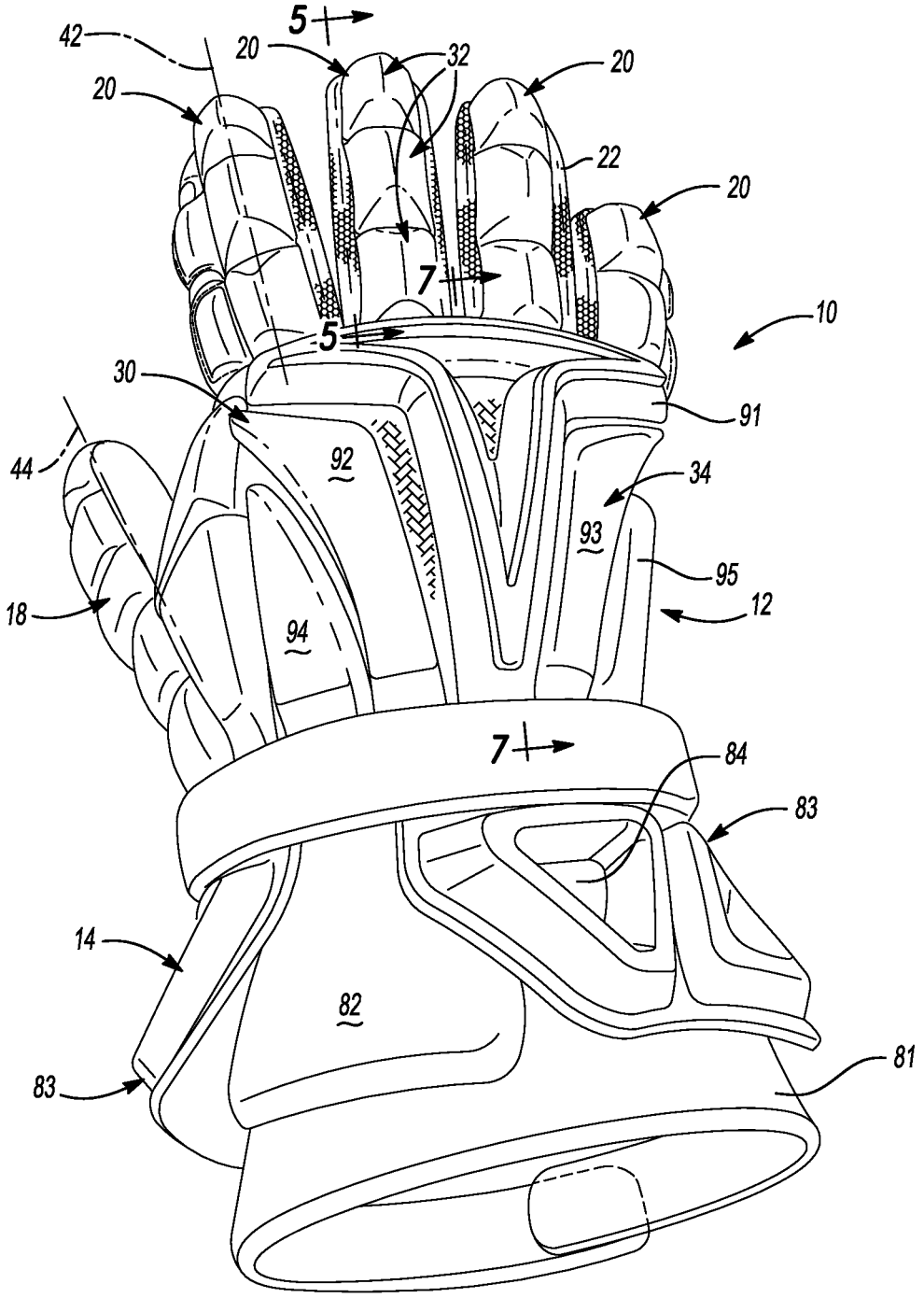
FIG. 1 is a perspective view of a protective glove in accordance with the principles of the present disclosure.

At least one backside pad 34 is attached to the back portion 22. As shown in FIG. 1, the backside pad(s) 34 are disposed generally between the finger portions 20 of the hand portion 12 and the wrist portion 14. Accordingly, the backside pad(s) 34 extends substantially over a back portion of a player's hand to protect the player's hand from injury during use.

In an example embodiment, the backside pad 34 is comprised of five pads. A primary backside pad 91 has a T shape and is arranged on the back portion 22 such that the top of the T aligns with the joint 39 between the finger portions 20 and the back portion 22. Four lateral pads are positioned on opposing lateral sides of the primary backside pad 91, two inner lateral pad 92, 93 and two outer lateral pads 94, 95. Attaching the backside pads 34 to the back portion 22 independent from one another allows adjacent pads 34 to be spaced apart and separated from one another as well as increases the flexibility as adjacent pads do not hinder movement of one another. The backside pad 34 may be comprised of more or less pads. As with the padded segments 32, the backside pads 34 may include an outer layer that generally surrounds an inner, energy-absorbing pad. Moreover, the backside pads 34 may have different shapes and arrangements thereof.

Figure 9B:
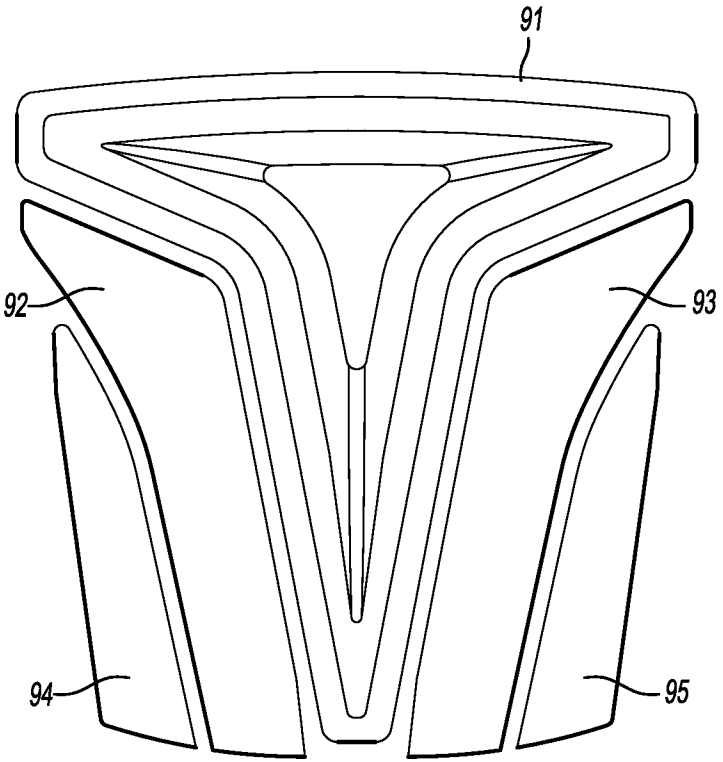
FIGS. 9A-9C are diagrams of example stitching patterns for the pads on backside of the protective glove.
Figure 9A:
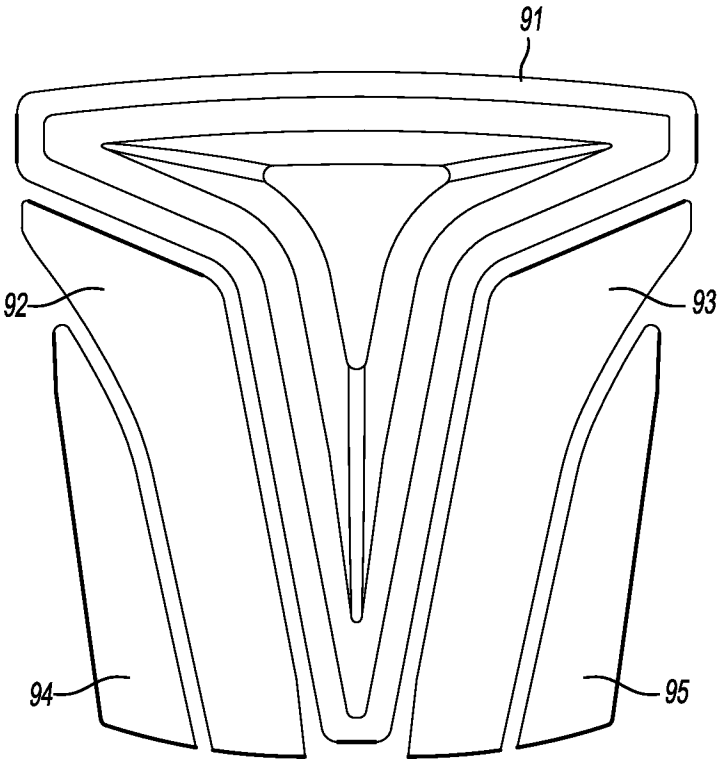
Figure 9C:
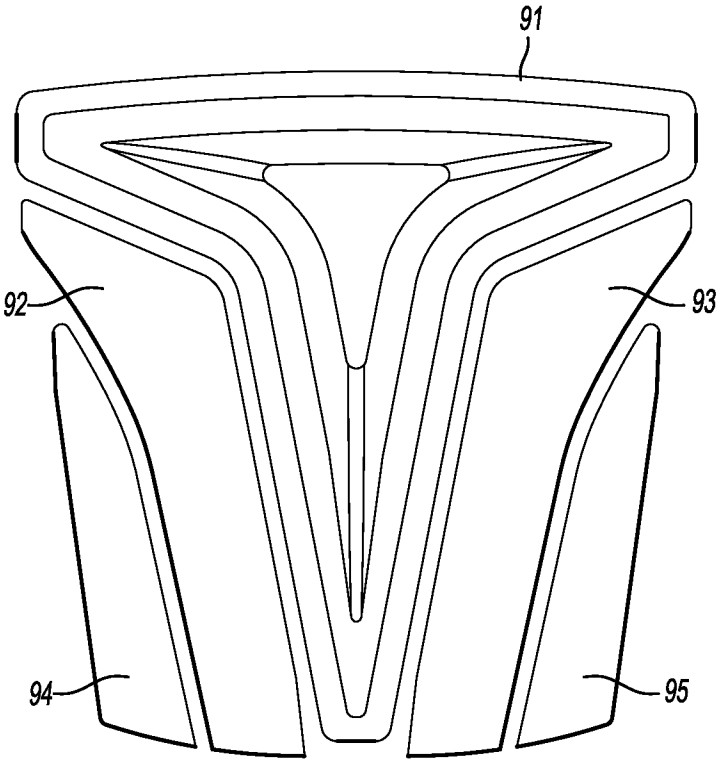

With particular reference to FIGS. 9A-9C, stitching patterns (as indicated by bold highlighting) for the lateral backside pads may also vary. Each lateral backside pad defines an upper edge, a lower edge and at least two lateral edges. In FIG. 9A, the upper edge and the lower edge of the inner lateral pads 92, 93 are attached to the back portion 22 while the at least two lateral edges are detached to the back portion 22; whereas, the outer lateral edge and the lower edge of the output lateral pads 94, 95 are attached to the back portion 22 while the inner lateral edge and the upper edge are detached from the back portion 22. In FIG. 9B, the upper edge, outer lateral edge and the lower edge of the inner lateral pads 92, 93 are attached to the back portion 22 while only the inner lateral edge is detached to the back portion 22; whereas, the outer lateral edge and the lower edge of the output lateral pads 94, 95 are attached to the back portion 22 while the inner lateral edge and the upper edge are detached from the back portion 22. In FIG. 9C, the outer lateral edge and the lower edge of the inner lateral pads 92, 93 are attached to the back portion 22 while the inner lateral edge and the upper edge are detached to the back portion 22; whereas, the outer lateral edge and the lower edge of the output lateral pads 94, 95 are attached to the back portion 22 while the inner lateral edge and the upper edge are detached from the back portion 22. Other stitching patterns for the pads are also contemplated by this disclosure.

Figure 4A:
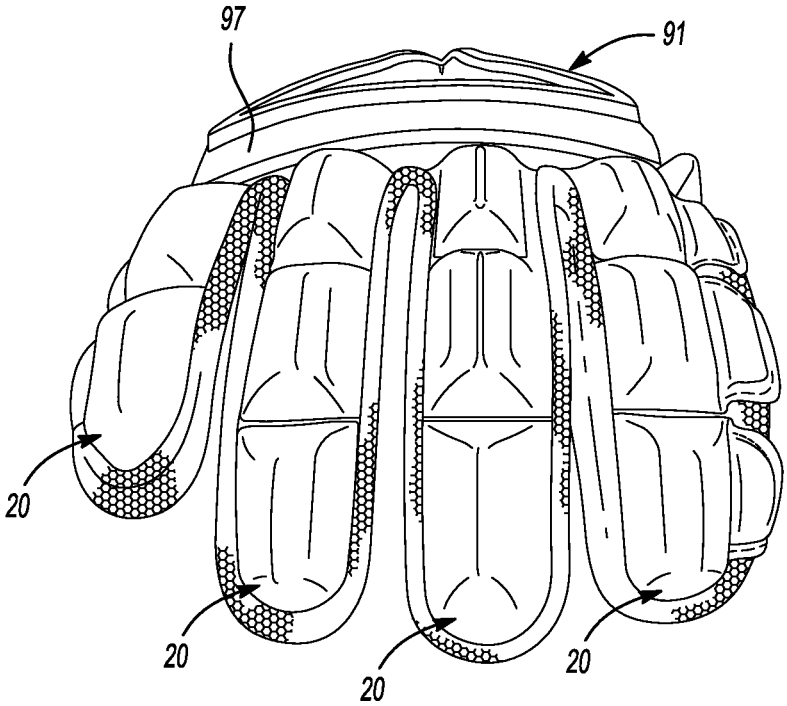
FIG. 4A is a front view of the protective glove shown in a relaxed state.
Figure 4B:
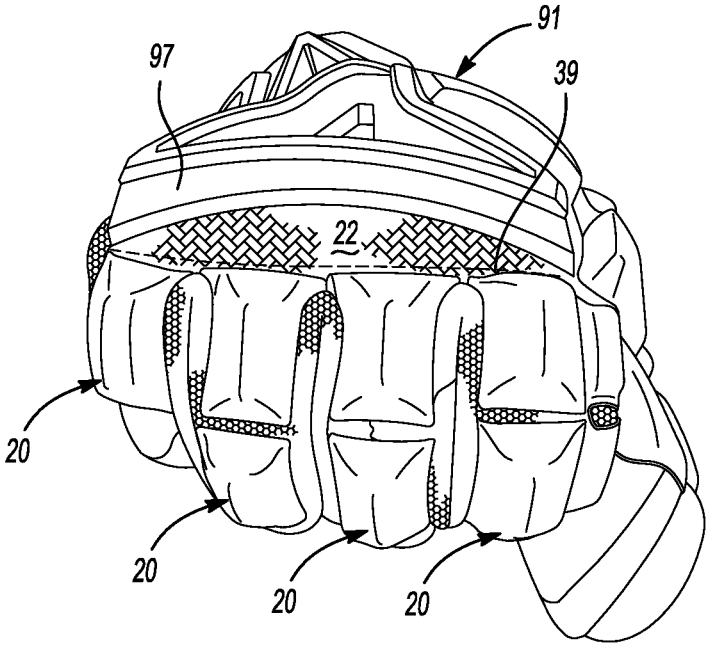
FIG. 4B is a front view of the protective glove shown in a flexed state.

In the example embodiment, the primary backside pad 91 is formed as a single unitary member comprised of a polyurethane material. The primary backside pad 91 defines an upper edge 76 and at least two other edges, such that the upper edge 76 of the backside pad aligns with and extends along the joint 39, wherein the upper edge 76 is detached from the back portion 22 and the two other edges of the pad are attached to the back portion 22. In this way, the padding arrangement provides improved flexibility. In the example embodiment, the upper edge of the backside pad 91 extends substantially along the entirety of the joint and attached along the outer sides of the back portion. In other embodiments, the upper edge of the backside pad may only extend along a portion of the joint. When the hand portion is moved from a relaxed state (FIG. 4A) to a flexed state, a greater degree of movement of the finger portions 20 is achieved as best seen in FIG. 4B.

Figure 7:
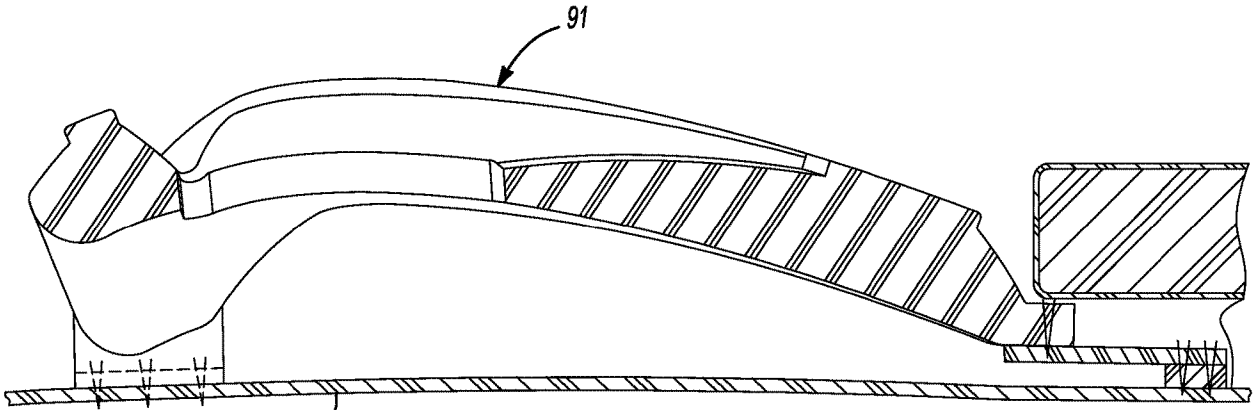
FIG. 7 is a cross-sectional view of the protective glove of FIG. 1 shown in a relaxed state and taken along line 7-7 of FIG. 1.
Figure 8:
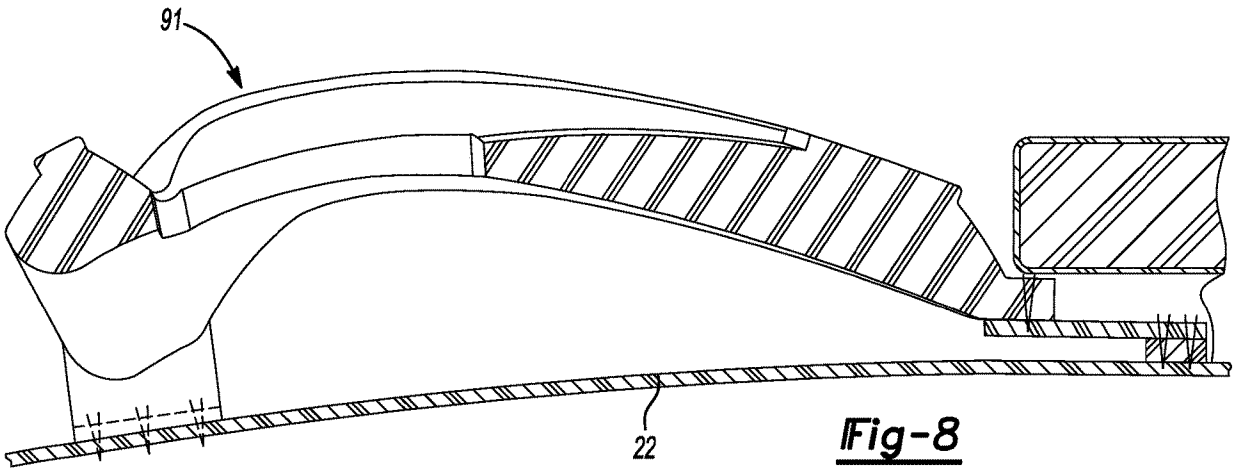
FIG. 8 shows the cross-sectional view of FIG. 7 in a flexed state.

With particular reference to FIGS. 7 and 8, the primary backside pad 91 is preferably attached via a tether 64 to the back portion 22. The primary backside pad 91 is attached to the back portion 22 at a lower edge 80, opposite the upper edge and adjacent the wrist portion 14. The tether 64 allows the primary backside pad to move between a relaxed state (FIG. 7) and a flexed state (FIG. 8) relative to the back portion 22. When the primary backside pad 34 is in the relaxed state, the lower edge 80 is disposed in proximity to the wrist portion 14. Conversely, when the primary backside pad 91 is in the flexed state, the primary backside pad 91 is moved in a direction away from the wrist portion 14. While the primary backside pad 91 is described and shown as including a padded panel 34 having a single tether 64, the primary backside pad 91 could be attached to the back portion 22 by more than one tether 64. Further, the primary backside pad 91 could include separate movable pad segments (not shown) that are individually attached to the back portion 22 via separate tethers 64.

The tether 64 may be formed from a material that biases the primary backside pad 91 into the relaxed state such as, for example, elastic. While the material of the tether 64 biases the primary backside pad 91 into the relaxed state, the material also permits movement of the primary backside pad 91 from the relaxed state and into the flexed state as the player moves the hand portion 12 between a relaxed state (FIG. 2) and a flexed state (FIG. 3) when grasping a lacrosse stick 24, for example. The tether 64 may be attached to the lower edge 80 of the primary backside pad 91 via stitching 82 and may likewise be attached to the back portion 22 via stitching 84.

In operation, when the hand portion 12 is in the relaxed state (FIG. 2), the tether 64 is likewise in a relaxed state and biases the primary backside pad 91 into a position substantially parallel to the back portion 22 (FIG. 7). When a force is exerted on the primary backside pad 91 when the hand portion 12 is moved into the flexed state (FIG. 3), a force is applied on the tether 64. The force causes the tether 64 to expand, which allows the primary backside pad 91 to likewise move into the flexed state (FIG. 8). It is noted that the material forming the back portion 22 conforms to the shape of the hand while the primary backside pad 91 is permitted to move independently from the back portion 22. For example, when the back portion 22 is moved into a substantially arc shape caused by the hand portion 12 being moved from the relaxed state to the flexed state, the primary backside pad 91 is likewise permitted to take a substantially arc shape, as the tether permits movement of the primary backside pad 91 in a direction substantially away from the wrist portion 14. The primary backside pad 91 is therefore allowed to flex when the player moves the hand portion 12 into the flexed state when grasping a lacrosse stick 24, for example.

When the force applied to the hand portion 12 is relaxed and the hand portion 12 is moved from the flexed state to the relaxed state, the tether 64 applies a force on the padded panel 34, thereby returning the padded panel 34 to the position shown in FIG. 7 due to the elastic nature of the tether 64. Accordingly, the tether 64 acts to return the padded panel 34 to a position substantially adjacent to the back portion 22 when the hand portion 12 is returned to the relaxed state.

A wrist protection portion 14 can extend from a bottom edge of the back portion 22 and includes at least one cuff with an aperture. In an example embodiment, the wrist portion 14 is comprised of an inner cuff 81, a middle cuff 82 and two outer cuffs 83. The two outer cuffs 83 are flanked on opposing sides of the middle cuff 82. The middle cuff 82 and the two outer cuffs 83 collectively serve to protect backside of the wrist. The inner cuff 81 also extends from the bottom edge of the back portion 22 and encircles the wrist of the user. The inner cuff 81 is partially encircled by the middle cuff 82 and the two outer cuffs 83. Each outer cuff 83 preferably includes an aperture 84 which increases ventilation while decreasing weight. Other types of cuff configurations also fall within the broader aspects of this disclosure. For example, the wrist protection portion 14 may be comprised more or less cuffs or constructed without cuffs.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A protective sports glove, comprising:

a palm portion;

a dorsal portion opposing the palm portion, wherein the dorsal portion attaches to the palm portion and cooperates with the palm portion to receive a metacarpus part of a hand;

a plurality of finger portions form at a joint along a top edge of the dorsal portion distal from a wrist and extending away from the dorsal portion, where the joint extends substantially the entirety of the top edge between opposing side edges of the dorsal portion;

at least one backside pad attached to the dorsal portion, the backside pad having an upper edge and at least two other edges, such that the upper edge of the backside pad aligns with and extends along at least a portion of the joint, wherein the upper edge is detached from the dorsal portion and the two other edges of the pad are attached to the dorsal portion.

2. The protective sports glove of claim 1 wherein a lower edge of the backside pad is attached via a tether to the dorsal portion and attached adjacent to a bottom edge of the dorsal portion.

3. The protective sports glove of claim 2 wherein the tether is comprised of an elastic material and biases the lower edge of the backside pad towards the wrist protection portion.

4. The protective sports glove of claim 1 wherein the backside pad has a T shape, such that a top of the T aligns with the joint and the top edge of the T extends substantially along the entirety of the joint.

5. The protective sports glove of claim 4 further comprises two lateral backside pads positioned on opposing lateral sides of the backside pad, wherein each lateral backside pad defines an upper edge, a lower edge and at least two lateral edges, such that upper edge and the lower edge are attached to the dorsal portion and the at least two lateral edges are detached to the dorsal portion.

6. The protective sports glove of claim 1 further comprises a plurality of padded segments extending along a length of each of said finger portions, including one padded segment proximate to the joint, wherein the one padded segment is attached to the respective finger portion at opposing side edges thereof and detached at an edge adjacent to the joint with the dorsal portion.

7. The protective sports glove of claim 1 further comprises a wrist protection portion extending from a bottom edge of the dorsal portion, wherein the wrist protection portion includes at least one cuff with an aperture there through.

8. The protective sports glove of claim 1 further comprises a wrist protection portion extending from a bottom edge of the dorsal portion, wherein the wrist protection portion includes a middle cuff and two outer cuffs flanked on opposing sides of the middle cuff, each outer cuff includes an aperture there through.

9. The protective sports glove of claim 8 wherein the wrist protection portion further includes an inner cuff extending from the bottom edge of the dorsal portion, where the middle cuff and the two outer cuffs partially encircle the inner cuff.

10. A protective sports glove, comprising:

a palm portion;

a dorsal portion opposing the palm portion, wherein the dorsal portion attaches to the palm portion and cooperates with the palm portion to receive a metacarpus part of a hand;

a plurality of finger portions secured at a joint along a top edge of the dorsal portion distal from a wrist and extending away from the dorsal portion, where the joint extends substantially the entirety of the top edge between opposing side edges of the dorsal portion;

at least one backside pad attached to the dorsal portion, the backside pad having an upper edge and at least two other edges, such that the upper edge of the pad aligns with and extends along at least a portion of the joint;

a plurality of padded segments extending along a length of each of said finger portions, including one padded segment proximate to the joint, wherein the one padded segment is attached to the respective finger portion at opposing side edges thereof and detached along an edge adjacent to the joint with the dorsal portion; and a wrist portion attached to an edge of the dorsal portion proximate to the wrist and opposite the distal edge of the dorsal portion.

11. The protective sports glove of claim 10 wherein the upper edge of the backside pad is detached from the dorsal portion and the two other edges of the backside pad are attached to the back portion.

12. The protective sports glove of claim 10 wherein a lower edge of the backside pad is attached via a tether to the dorsal portion and attached adjacent to a bottom edge of the dorsal portion.

13. The protective sports glove of claim 12 wherein the tether is comprised of an elastic material and biases the lower edge of the backside pad towards the wrist protection portion.

14. The protective sports glove of claim 10 wherein the backside pad has a T shape, such that a top of the T aligns with the joint.

15. The protective sports glove of claim 14 further comprises two lateral backside pads positioned on opposing lateral sides of the backside pad, wherein each lateral backside pad defines an upper edge, a lower edge and at least two lateral edges, such that upper edge and the lower edge are attached to the dorsal portion and the at least two lateral edges are detached to the dorsal portion.

16. The protective sports glove of claim 10 further comprises a plurality of padded segments extending along a length of each of said finger portions, including one padded segment proximate to the joint, wherein the one padded segment is attached to the respective finger portion at opposing side edges thereof and detached at an edge adjacent to the joint with the dorsal portion.

17. The protective sports glove of claim 10 further comprises a wrist protection portion extending from a bottom edge of the dorsal portion, wherein the wrist protection portion includes at least one cuff with an aperture there through.

18. The protective sports glove of claim 10 further comprises a wrist protection portion extending from a bottom edge of the dorsal portion, wherein the wrist protection portion includes a middle cuff and two outer cuffs flanked on opposing sides of the middle cuff, each outer cuff includes an aperture there through.

19. The protective sports glove of claim 18 wherein the wrist protection portion further includes an inner cuff extending from the bottom edge of the dorsal portion, where the middle cuff and the two outer cuffs partially encircle the inner cuff.

* * * * *